US006435437B1

(12) United States Patent
Ahrens

(10) Patent No.: US 6,435,437 B1
(45) Date of Patent: Aug. 20, 2002

(54) WIRE MANDREL HAVING A SPRING BIASED RESTRAINING ARM IN A WIRE UNCOILER

(75) Inventor: Matthew C. Ahrens, Malta, IL (US)

(73) Assignee: Rockford Manufacturing Group, Inc., South Beloit, IL (US)

( * ) Notice: Subject to any disclaimer, the term of this patent is extended or adjusted under 35 U.S.C. 154(b) by 0 days.

(21) Appl. No.: 09/923,378

(22) Filed: Aug. 6, 2001

(51) Int. Cl.[7] ..... B65H 49/30; B65H 19/10; B65H 75/24

(52) U.S. Cl. ..... 242/127; 242/559.2; 242/577.1

(58) Field of Search ..... 242/127, 577.1, 242/597.3, 131, 141

(56) References Cited

U.S. PATENT DOCUMENTS 1,839,321 A * 1/1932 Kent ..... 242/577.1 X
2,583,667 A * 1/1952 Pratt ..... 242/577.1
3,794,263 A * 2/1974 Delerue ..... 242/127
3,885,754 A * 5/1975 Delerue ..... 242/127
4,185,442 A * 1/1980 Johnson et al. ..... 242/559.2 X
4,512,533 A * 4/1985 Morival et al. ..... 242/129
4,743,335 A * 5/1988 Krappitz et al. ..... 242/559.2 X
5,890,645 A 4/1999 Schooley et al. ..... 228/173.5

* cited by examiner

*Primary Examiner*—Michael R. Mansen
*Assistant Examiner*—Minh-Chau Pham
(74) *Attorney, Agent, or Firm*—Leydig, Voit & Mayer, Ltd.

(57) ABSTRACT

A wire uncoiler for holding coils of wire on mandrels for uncoiling and drawing by a downstream wire drawing machine. The movable restraining arm of each mandrel is biased by a spring mechanism to control wire payoff to the downstream drawing machine. The spring mechanism can be manually adjusted by a crank handle to control the tension in the spring and therefore the amount of restraining force applied by the restraining arm. The manual adjustment can be done while the wire drawing machine is actively drawing wire from the mandrel.

26 Claims, 5 Drawing Sheets

WIRE MANDREL HAVING A SPRING BIASED RESTRAINING ARM IN A WIRE UNCOILER

FIELD OF THE INVENTION

The present invention relates generally to the field of wire uncoilers for holding wire coils to be drawn by a wire drawing machine.

BACKGROUND OF THE INVENTION

Wire or cable is typically provided from a wire manufacturer in the form of a wound spool or coil having a predetermined number of lineal feet. Such a configuration allows for relatively easy storage and transportation of wire. However, it is often necessary to cut the coiled wire into individual lengths of straight wire for commercial purposes and end use. The wire from the coils are therefore often fed into a wire cutting machine which cuts the wire into short strips for use. With such a system, the coil is placed onto a wire uncoiler which is either driven to feed the lead end of the wire coil to the wire cutter or drawn off the coil via a wire drawing machine for use.

As with many high volume production processes, this period of downtime directly relates to a loss in production and thus a loss in profits. Various attempts have been devised to provide a means of continuously feeding wire and thereby avoid downtime. One such example is provided in a wire uncoiler placed upstream of a wire drawing machine that has a Z-shaped or S-shaped configuration with parallel mandrels extending horizontally on a rotatable carousel. A wire coil is placed on one mandrel and the lead end of the wire contained in that coil is pulled by the wire drawing machine. As the wire is being pulled, the trailing end of the wire contained in the coil is manually welded to the leading end of an idle coil which is placed on the other idle mandrel. Once the active wire coil is exhausted, the carousel is rotated 180 ° and thereby makes the idle mandrel the active mandrel. The process can be continued by loading another coil onto the now idle mandrel and conducting another welding operation.

Although Z-shaped or S-shaped wire uncoilers have met with much commercial success and acceptance, they have not been without deficiencies. One existing deficiency is that it has been difficult to provide a consistent wire payoff from the wire uncoiler to the wire drawing machine. The source of this deficiency relates to the restraining arm of each mandrel, and more particularly the way in which the restraining arms restrain the bottom of the wire coil and control/guide the payoff of wire from the mandrel to the wire drawing machine. In prior systems, the restraining arm has been free floating utilizing its own weight to apply a vertically downward force to the end loop of wire and thereby control the payoff of wire. However, this has caused less consistent wire payoff because different wire gauges are used in these systems (typically in range of between 7/32 and 5/8 inches in diameter), that drawing machines have different pull or draw characteristics, and also that wire coil characteristics can change from coil to coil for the same gauge wire (e.g. tightly or loosely coiled wire). There has been an attempt to adjust the weight at the end of the restraining arm and therefore restraining force of the restraining arm via attachable and detachable weights. However, this requires storage for the weights and limits the amount of adjustment to the weight intervals. Moreover, it is very difficult if not impossible to adjust the weight or restraining force during continuous operation, requiring downtime for weight adjustment, which is undesireable as previously indicated.

BRIEF SUMMARY OF THE INVENTION

In light of the above, it is a general aim of the present invention to provide a wire uncoiler with an improved way to adjust the restraining force applied by the restraining arm.

According to one aspect of the invention, it is an object to provide a wire uncoiler with a restraining force that can be adjusted while wire is being drawn off of the mandrel.

In accordance with these and other objectives, the present invention is directed toward a wire uncoiler for holding coils of wire on mandrels for uncoiling in which the movable restraining arm is biased by a spring mechanism to control wire payoff to a downstream drawing machine. The wire uncoiler includes at least one vertical support extending vertical upward to support the mandrel horizontally at a vertical elevation. The mandrel extends horizontally to a first end where wire is adapted to be drawn off. The restraining arm extends horizontally below one of the mandrels for engaging wire coils when placed on the mandrel. The restraining arm has a second end that is vertically movable relative to the first end of the mandrel to control wire payoff from wire coils in conjunction with the first end. A spring mechanism supported by one of the vertical supports acts on the restraining arm to bias the ends of restraining arm and mandrel away from each other.

According to a preferred embodiment, the apparatus includes pairs of the mandrels on a rotary carousel that is adapted to rotate on a stationary support base. By having two or more pairs of mandrels, one mandrel can be actively paying off wire to a downstream wire drawing machine while the other mandrel is being loaded with wire. When the wire coil on the active mandrel is exhausted, the carousel can be rotated to switch the positions of the mandrels such that the idle mandrel is now active to pay off wire to the drawing machine. A worker can then load a new wire coil on the exhausted and now idle mandrel.

It is an aspect of the present invention that a manual control is provided to adjust the biasing force exerted by the spring mechanism. The manual control adapted to be manually actuated to adjust the biasing force. The manual control may include an extendible and retractable screw mechanism including a threaded shaft threaded into a threaded bore formed in a body. The screw mechanism has a first end attached to the spring mechanism and a second end adapted to be rotated to control the biasing force applied by the spring mechanism. The second end may be attached to a crank handle that can be manually grasped and rotated.

It is another aspect of present invention that the spring mechanism and the manual control are mounted to the vertical support where adjustment of the spring mechanism can be made during operation without downtime when wire is being uncoiled off of the mandrel.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Referring to the FIGS. generally, a preferred embodiment according to the present invention has been illustrated as wire uncoiler 10 for holding coils 12, 13 of wire 14 for uncoiling and drawing by a downstream wire drawing machine 16. Typically, the wire drawing machine 16 will feed the wire 14 into a downstream wire cutting machine (not shown) which cuts the wire into individual length of wire. The wire uncoiler 10 is generally built from rigid steel structural components to provide sufficient support for wire coils 12 that often weigh up to 6,500 pounds. Actual weight may vary depending upon the wire gauge, as the uncoiler 10 is suitable for use with different wire gauges including a typical diameter range of between about 7/32 and about 5/8 inches.

Figure 1:
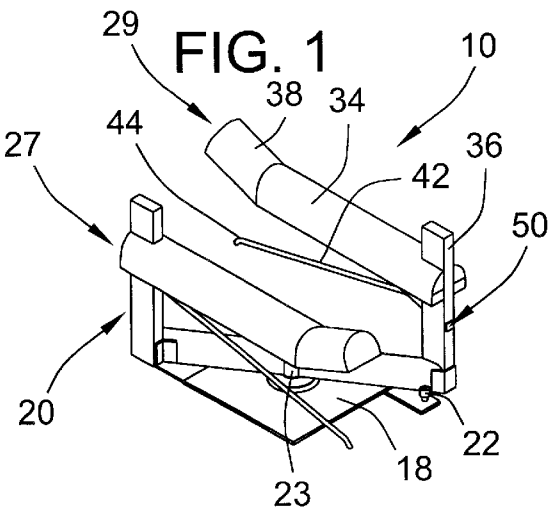
FIGS. 1–6 are isometrics views of a wire uncoiler for holding wire coils for uncoiling and drawing by a wire drawing machine, in accordance with a preferred embodiment of the present invention, with each subsequent figure illustrating a progression of normal operation of the wire uncoiler.
Figure 2:
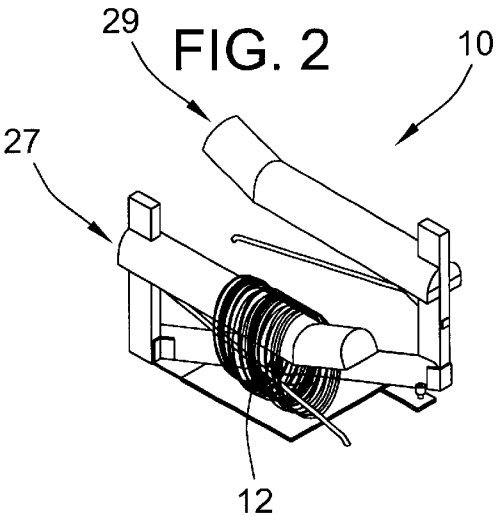
Figure 3:
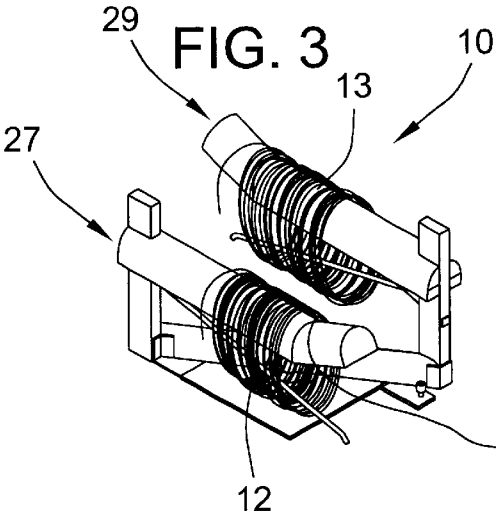
Figure 4:
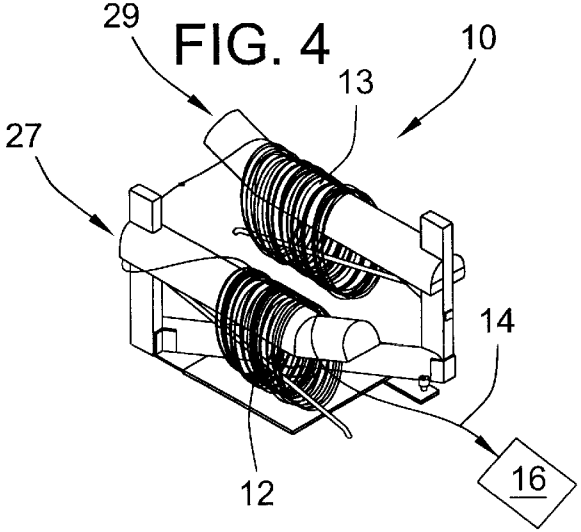
Figure 5:
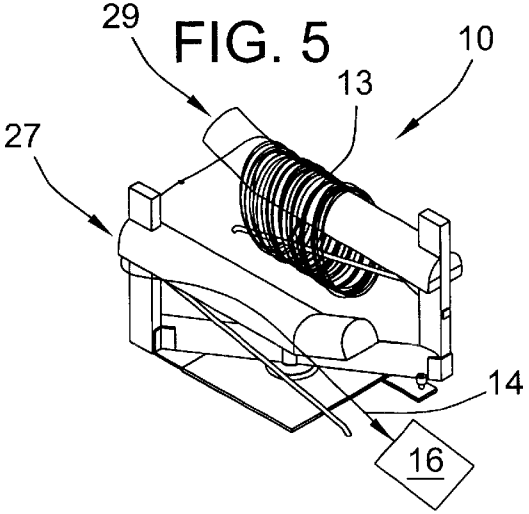
Figure 6:
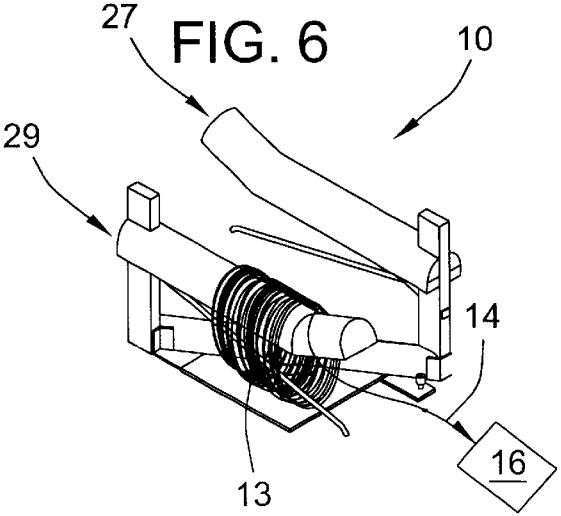
Figure 7:
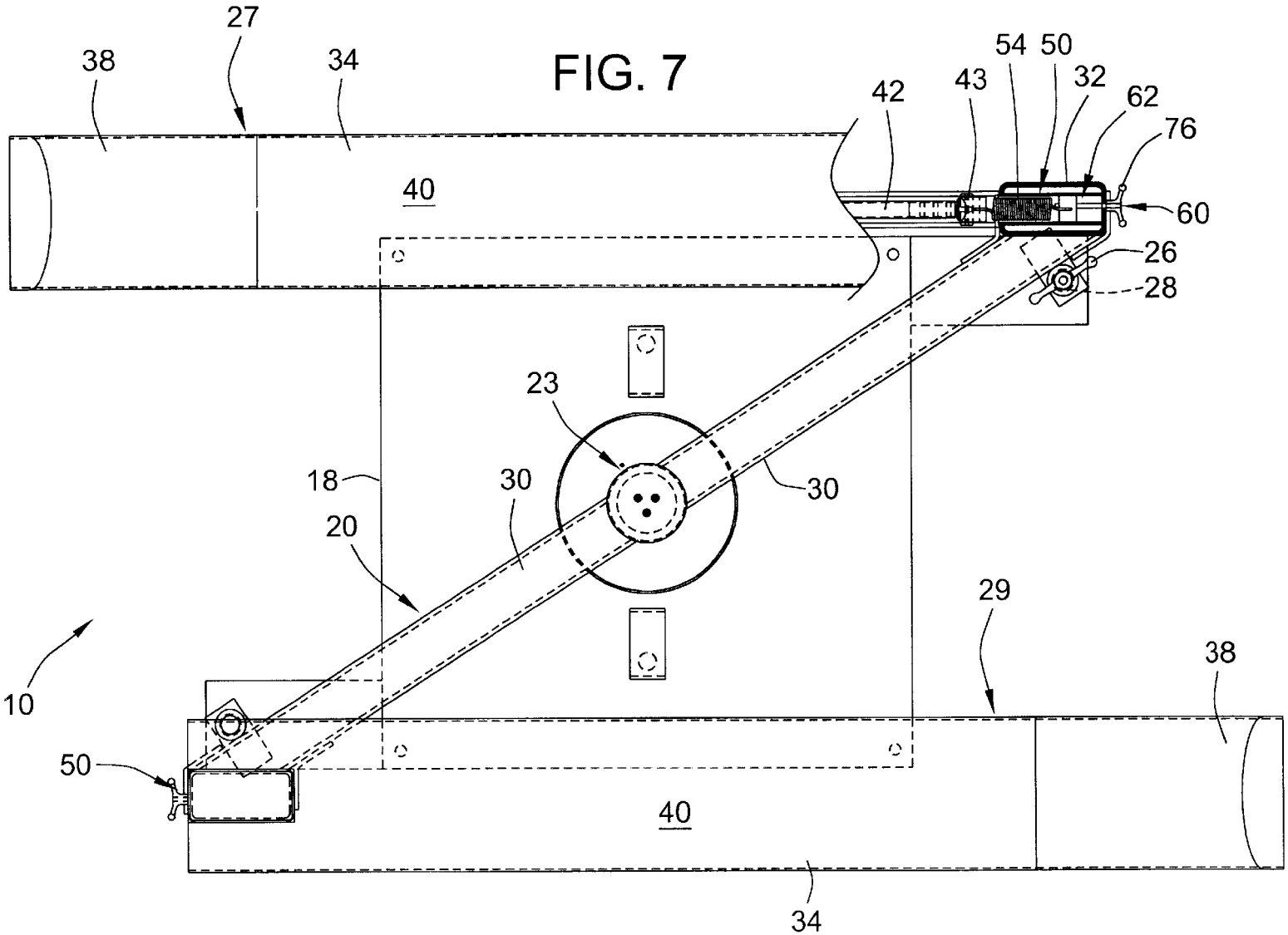
FIG. 7 is a top plan view of the wire uncoiler illustrated in FIG. 1, with a portion illustrated in paial cross section.
Figure 8:
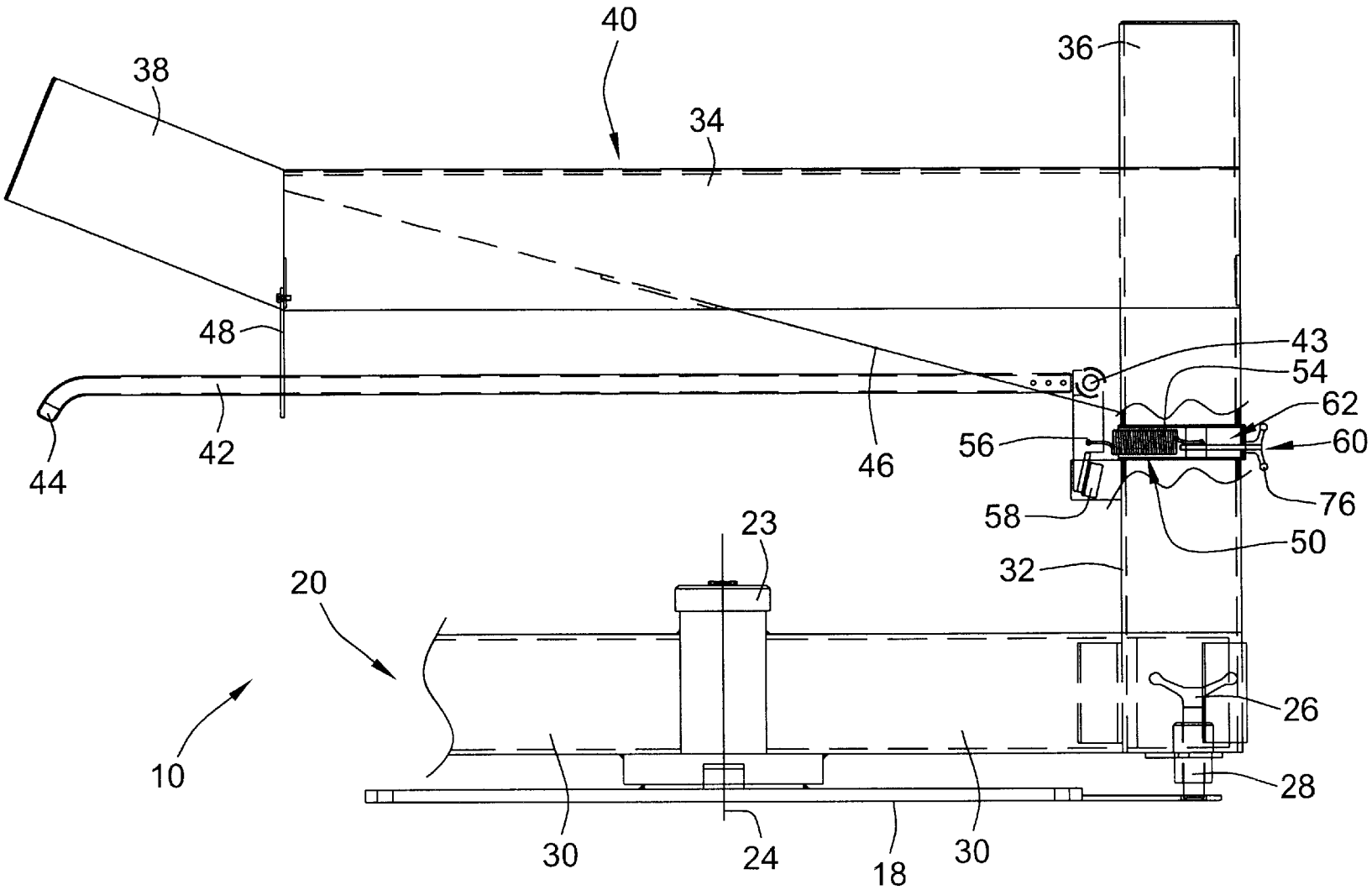
FIG. 8 is a fragmented side elevation view of the wire uncoiler illustrated in FIG. 1, with a portion illustrated in cross section.

Referring to FIGS. 7–8, the wire uncoiler 10 generally includes a stationary support base 18 and a rotary carousel 20. The rotary carousel 20 is mounted to the stationary support base 18 at a central bearing hub assembly 23 for rotation about a vertical axis 24. The support base 18 may be secured to the shop floor to securely fix the position of the wire uncoiler 10. The uncoiler 10 also includes a lock mechanism 22 between the carousel 20 and the support base 18 for locking the carousel 20 in different angular positions about the axis 24. In the disclosed embodiment, the carousel 20 can be locked in two positions spaced 180° apart and comprises a pin 26 that inserts into a hole 28 formed in the support base 18. When the pin 26 is inserted, the pin 26 engages the carousel 20 to prevent rotation of the carousel 20. The pin 26 can be removed to allow the carousel 20 to rotate one half rotation and then reinserted to again lock the carousel 20 in position.

Referring to FIGS. 1–6 which illustrate a progression of operation, the rotary carousel 20 includes two mandrel assemblies 27, 29 which are built of the same structural components. Each mandrel assembly 27, 29 supports a wire coil 12, 13 at a vertical elevation above the shop floor. In operation, the wire drawing machine 16 will be actively drawing off wire 14 from only one mandrel assembly 27 at a time while the other mandrel 29 is idle for wire coil reloading and wire connection/welding operations. For purposes of reference and differentiation, the mandrel assembly 27 (and its associated structural components) aligned in line with the wire drawing machine 16 with wire being drawn or pulled thereby is designated as "active" (e.g. the active mandrel 34) while the other mandrel assembly 29 (and its associated structural components) is designated as "idle" (e.g. the idle mandrel 34). It will be appreciated that during operation when the wire coil on the active mandrel assembly 27 is exhausted, the carousel 20 is rotated and the idle mandrel assembly 29 becomes active and the active mandrel assembly 27 becomes idle. When wire 14 is being drawn from the uncoiler 10, only the wire 14 from the wire coil 12 supported on the active mandrel assembly 27 is being drawn by the wire drawing machine 16 for consumption. While wire 14 is being drawn off the active mandrel assembly 27, a worker mounts new wire coil 13 on the idle mandrel assembly 29. The trailing end of the wire 14 contained in the active wire coil 12 on the active mandrel assembly 27 is then wrapped behind the active mandrel assembly 27 and welded to the leading end of wire 14 contained in the idle wire coil 13 on the idle mandrel assembly 29. When the active wire coil 12 is exhausted, the carousel 20 is rotated one half of a rotation which brings the idle mandrel assembly 29 in line with the wire drawing machine 16 and wire 14 is now drawn off the idle mandrel assembly 29 (and hence now becomes the active mandrel assembly). This process can be repeated (e.g. by loading another coil onto the now idle mandrel and conducting another welding operation) such that wire drawing can be completed without downtime on a continuous basis.

While the invention is advantageous and desirable for use in a continuous operating uncoiler 10 as disclosed herein, it will be the invention may also be incorporated into an apparatus that is non-continuous in operation that only includes one mandrel assembly or also an apparatus that includes more than two mandrel assemblies, or other such uncoilers. Certain claims appended hereto are meant to include these and other possibilities.

Because the mandrel assemblies 27, 29 are identical structural, reference can be had to either one of the mandrel assemblies 27, 29 in the drawings for purposes of understanding the disclosure herein. As such, the same reference numbers are used herein to designate the same structural components in both mandrel assemblies 27, 29.

Referring in greater detail to the structure of the mandrel assemblies with reference to FIGS. 7–8, the rotary carousel 20 includes a carousel base in the disclosed form of two horizontal support arms 30 that project horizontally outward from the bearing hub assembly 23 in opposing directions. The ends of the support arms 30 support a parallel pair of vertical support posts 32 that in turn support a parallel pair of horizontally extending mandrels 34. Reinforcing gussets 46 diagonally between the vertical support posts 32 and the mandrels 34 may be used to increase structural integrity. The mandrels 34 support the wire coils 12, 13 at a desired vertical elevation off of the shop floor. The vertical support posts 32 may have end portions 36 that project vertically above the mandrels 34 to prevent loops of wire 14 from falling of one end of the mandrels 34. At the other end, the mandrels 34 may have upwardly angled tips ends 38 that also prevent loops of wire 14 from falling off via gravity while at the same time permitting loops of wire to be pulled or drawn off by the wire drawing machine 16 when in use. A central saddle portion 40 is formed on each mandrel 34 between the upwardly angled tip end 38 and the vertically upright end portion 36 to provides a natural depression for wire coil 12 to sit.

To control the wire payoff to the wire drawing machine 16, each mandrel assembly 27, 29 also includes a vertically movable restraining arm 42. The vertical support posts 32 support the restraining arms 42 (through gussets 46) horizontally in line with the mandrels 34 and below the mandrels 34 such that the restraining arms 42 are adapted to apply a restraining force to the bottom portion or the wire coils 12, 13 carried on the mandrels 34. In the disclosed embodiment, the restraining arms 42 are pivotably mounted to the reinforcing gussets 46 at pivot hinge 43. Each restraining arm 42 also includes a downwardly angled end 44 that is in vertical alignment with and is vertically movable relative to the upwardly angled end 38 of each mandrel 34. The downwardly and upwardly angled ends 38, 44 work in conjunction with each other to engage the leading loop of the active wire coil 12 and thereby control the payoff of wire 14 being drawn by the wire drawing machine 16. To facilitate loading of a wire coil 13 onto the mandrel 34, each mandrel includes a hook, support, or latch 48 for removably latching the restraining arms in a raised position that is substantially horizontal, thereby keeping the ends 38, 44 of the mandrel and restraining arm 42 close together to allow easier loading of new wire coils 13.

Figure 9:
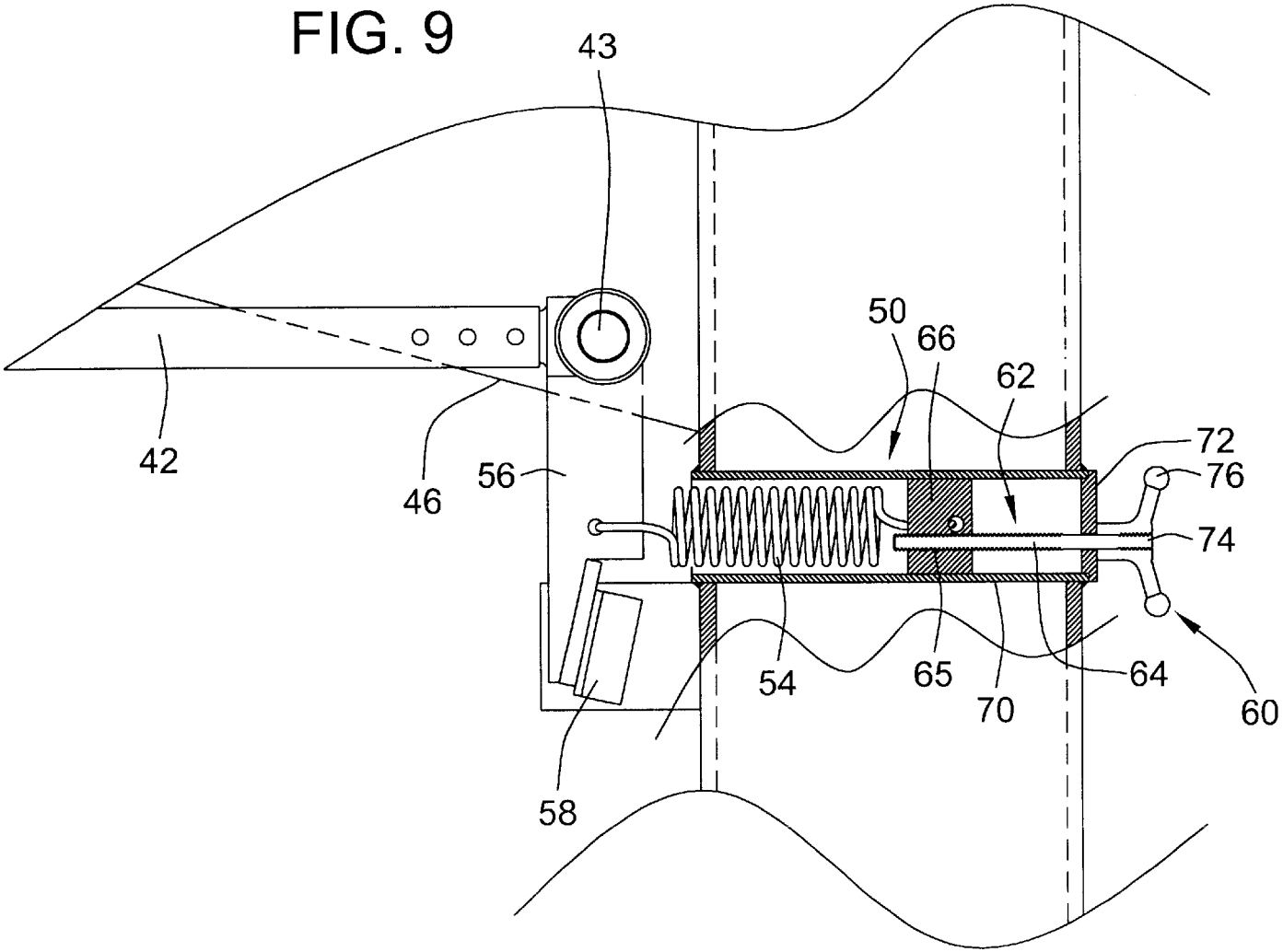
FIG. 9 is an larged view of a the portion illustrated in cross section illustrated in FIG. 8.
Figure 10:
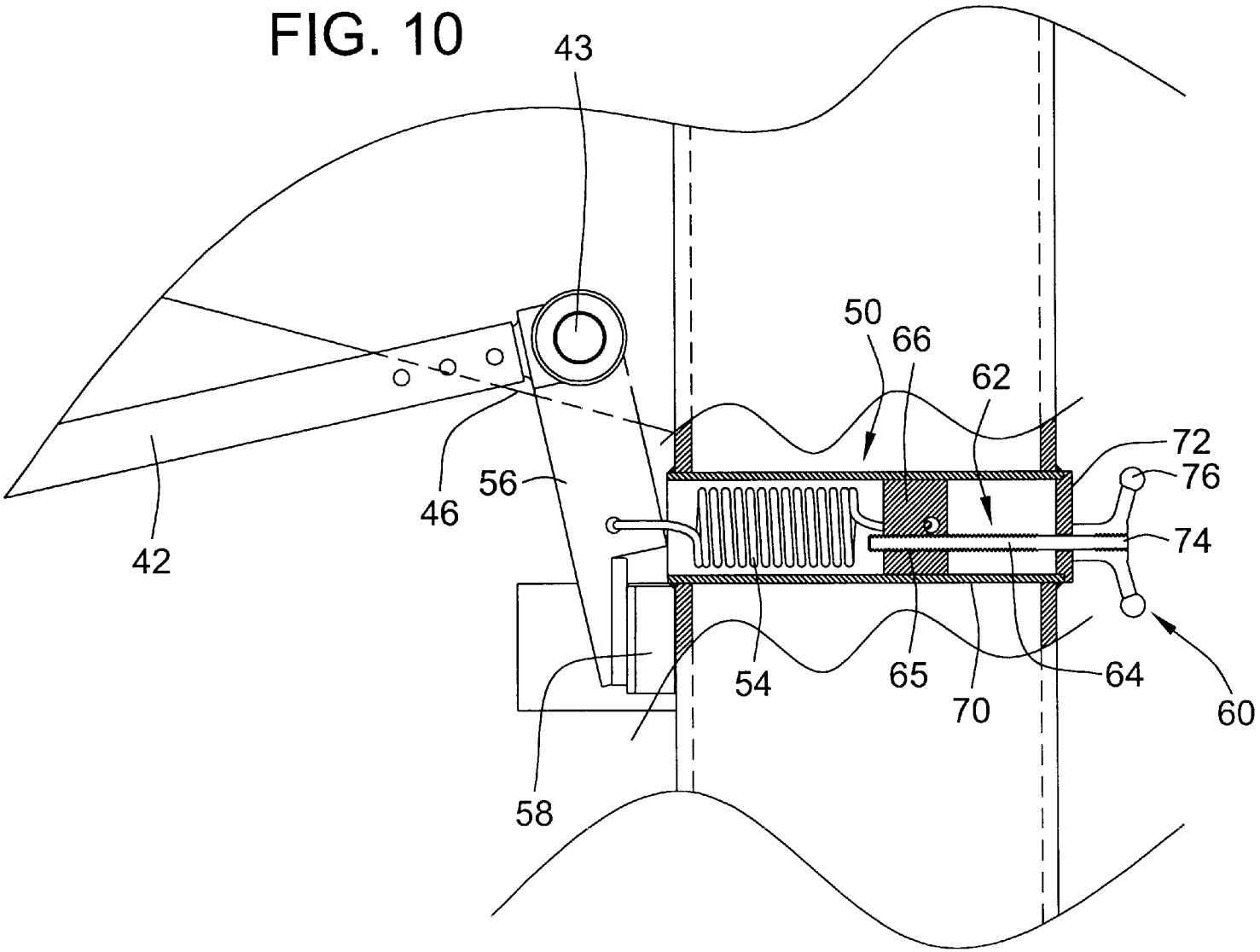
FIG. 10 is the same view as FIG. 9 but with the restraining arm rotated.

In accordance with the present invention, the disclosed embodiment includes a spring mechanism 50 for each restraining arm 42 that bias the end 44 of the restraining arm 42 downward away from the mandrel 34, as shown in FIGS. 7–8 and in enlarged detail in FIGS. 9–10. The spring mechanism 50 provides additional restraining force to the wire in addition to the weight of the restraining arm 42 itself. In the preferred embodiment, the spring mechanism 50 includes a coil spring 54 arranged in tension to provide additional restraining force, however, it will be appreciated that other spring mechanisms could also be used in other less preferred embodiments including compressed coil springs, torsion springs placed at the pivot, other forms of metal springs, resilient rubber members, adjustable air shocks, etc. Certain claims appended hereto are meant to include these and other alternate possibilities. The coil spring 54 acts on each restraining arm 42 through a lever arm 56 to effect a downward bias on the restraining arm 42. The lever arm 56 is perpendicularly affixed to the restraining arm 42 and projects vertically downward from the pivot hinge 42. The lever arm 56 also includes a stop pad 58 that engages the vertical support post 32 to limit downward pivoting movement of the restraining arm 34 to a point above the shop floor. This also sets a predetermined maximum distance between the ends 38, 44 of the mandrel and restraining arm.

In the disclosed embodiment, a manual control 60 is provided for adjusting the biasing force of the spring mechanism 50. Preferably, the spring mechanism 50 and the manual control 60 are mounted to the vertical support posts 32 away from the action at the ends 38, 44 of the active mandrel and restraining arm such that the spring mechanism 50 can be adjusted at the same time wire 14 is being drawn off of the mandrel 34.

In the disclosed embodiment, the manual control 60 includes an extendible and retractable screw mechanism 62. The screw mechanism 62 includes a threaded shaft 64 threaded into a threaded bore 65 of a square plug body 66. The plug body 66 is secured to an end of the coil spring 54. The plug body 66 slides horizontally (but does not rotate) within a square tube 70 that is welded to a rectangular opening horizontally through the vertical support post 32. One end of the tube 70 is enclosed by an end plate 72 welded thereto. The threaded shaft 64 projects through the end plate 72 to provide a workable end 74 outside of the vertical support post 32 that can be worked and rotated to adjust the tension in the spring 54 and therefore the restraining force applied by the restraining arm 42. Rotation of the workable end 74 causes the plug body 66 to linearly translate within the square tube 70 and thereby increase or decrease spring tension. To facilitate rotation of the threaded shaft 64 and knob or manual crank handle 76 is secured to the workable end 74. The workable end 74 may also simply be a hex that can be manually worked by a wrench or other tool.

The spring mechanism 50 increases the restraining force of the restraining arm 42. During operation, a worker will evaluate how well wire is being drawn off of the active mandrel assembly 34. If the wire 14 is being drawn off in a sloppy or inconsistent manner, the worker can rotate the crank handle 76 in a direction that increases tension in the coil spring 54 and therefore tightens the drawn wire as desired. If on the other hand, the restraining arm 42 is being overly restrictive, the worker can rotate the crank handle 76 in a reverse direction that lessens tension in the coil spring 54 and allows wire to be more easily drawn off the mandrel. As the manual control 60 is located away from the activity, all of these adjustments can be made while wire is being drawn thereby avoiding downtime. The worker can fine tune and repetitively adjust as necessary to apply the desired restraining force with the restraining arm 42.

All of the references cited herein, including patents, patent applications, and publications, are hereby incorporated in their entireties by reference.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A wire uncoiler for holding coils of wire for uncoiling, comprising:

a vertical support;

a mandrel supported by the vertical support and extending horizontally from the vertical support to a first end, the mandrel adapted to received and support coils of wire with wire adapted to be uncoiled past the first end;

a restraining arm carried extending horizontally below the mandrel for engaging wire coils carried on the mandrel, the restraining arm having a second end vertically movable relative to the first end; and a spring mechanism acting on the restraining arm biasing the second end away from the first end with a biasing force.

2. The wire uncoiler of claim 1 further comprising a manual control adjusting the biasing force exerted by the spring mechanism, the manual control adapted to be manually actuated to adjust the biasing force.

3. The wire uncoiler of claim 2 wherein the spring mechanism and the manual control are mounted to the vertical support wherein adjustment of the spring mechanism can be made when wire is being uncoiled off of the mandrel.

4. The wire uncoiler of claim 2 wherein the manual control includes an extendible and retractable screw mechanism including a threaded shaft and a body having a threaded bore, the screw mechanism having a first end attached to the spring mechanism and a second end adapted to be rotated to control the biasing force applied by the spring mechanism.

5. The wire uncoiler of claim 4 wherein the spring mechanism comprises a coil spring in tension to create the biasing force.

6. The wire uncoiler of claim 5 wherein the restraining arm is pivotable about a pivot, the pivot being supported by the vertical support, further comprising a lever arm affixed to the restraining arm and projecting substantally perpendicular from the re straining arm, the coil spring connecting the screw mechanism with the lever arm.

7. The wire uncoiler of claim 6 wherein the lever arm engages the vertical support when the first end of the mandrel and the second end of the restraining arm are a predetermined distance apart setting a predetermined maximum distance between the first end of the mandrel and the second end of the restraining arm.

8. The wire uncoiler of claim 4 further comprising a manual crank attached to the second end of the screw mechanism.

9. A wire uncoiler for holding coils of wire for uncoiling, comprising:

a support base;

a carousel base rotatably mounted to the support base;

a plurality of vertical supports extending vertical upward from the carousel base;

a plurality of mandrels, each mandrel supported by one of the vertical supports and extending horizontally from said one of the vertical supports to a first end, the mandrels adapted to received and support coils of wire with wire adapted to be uncoiled past the first end of each mandrel;

a plurality of restraining arms, each retraining arm extending horizontally below one of the mandrels for engaging wire coils carried on the mandrel, each restraining arm having a second end vertically movable relative to the first end; and a plurality of spring mechanisms, each spring mechanism acting on one of the restraining arms biasing the second end away from the first end with a biasing force.

10. The wire uncoiler of claim 9 further comprising a plurality of manual controls, one manual control for each spring mechanism, the manual controls adjusting the biasing force exerted by the spring mechanisms, the manual controls adapted to be manually actuated to adjust the biasing force of each spring mechanism.

11. The wire uncoiler of claim 10 wherein the spring mechanisms and the manual controls are mounted to the vertical supports wherein adjustment of the spring mechanism can be made when wire is being uncoiled off of the mandrel.

12. The wire uncoiler of claim 10 wherein each of the manual controls includes an extendible and retractable screw mechanism including a threaded shaft and a body having a threaded bore, the screw mechanism having a first end attached to one of the spring mechanisms and a second end adapted to be rotated to control the biasing force applied by the spring mechanism.

13. The wire uncoiler of claim 12 wherein each of the spring mechanisms comprise a coil spring in tension to create the biasing force.

14. The wire uncoiler of claim 13 wherein each of the restraining arms are pivotable about a pivot, each pivot being supported by one of the vertical supports, further comprising a plurality of lever arms, one lever arm for each restraining arm, each lever arm affixed to one of the restraining arms and projecting substantially perpendicular therefrom, the coil spring of each spring mechanism connecting the screw mechanism with the lever arm.

15. The wire uncoiler of claim 14 wherein the lever arms engage the vertical supports when the first end of the respective mandrel and the second end of the respective restraining arm are a predetermined distance apart setting a predetermined maximum distance between the first end of the respective mandrel and the second end of the respective restraining arm.

16. The wire uncoiler of claim 12 further comprising a manual crank attached to the second end of the screw mechanism.

17. A wire uncoiler for holding coils of wire to be uncoiled by a wire drawing machine, comprising:

a support base;

a carousel base rotatably mounted to the support base for rotation about a vertical axis;

an active vertical support extending vertically upward from the carousel base;

an idle vertical support extending vertically upward from the carousel base, the idle vertical support and active vertical supports being angularly spaced on opposite sides of the vertical axis;

an active mandrel supported by the active vertical support and extending horizontally from the active vertical support to a first upwardly angled end, the active mandrel adapted to received and support coils of wire with wire adapted to be uncoiled past the first upwardly angled end;

an idle mandrel supported by the idle vertical support and extending horizontally from the idle vertical support generally parallel with the active mandrel to a second upwardly angled end, the idle mandrel adapted to received and support coils of wire with wire adapted to be uncoiled past the second upwardly angled end;

an active restraining arm supported by the active vertical support and extending horizontally below the active mandrel for engaging wire coils carried on the active mandrel, the active restraining arm having a first downwardly angled end vertically movable relative to the first upwardly angled end;

an idle restraining arm supported by the idle vertical support and extending horizontally below the idle mandrel for engaging wire coils carried on the idle mandrel, the idle restraining arm having a second downwardly angled end vertically movable relative to the second upwardly angled end;

a first spring mechanism supported by the active vertical support, the first spring mechanism having a first biasing force acting on the active restraining arm biasing the first downwardly angled end away from the first upwardly angled end;

a second spring mechanism supported by the idle vertical support, the second spring mechanism having a second biasing force acting on the idle restraining arm biasing the second downwardly angled end away from the second upwardly angled end; and a lock between the carousel base and the support base, the lock locking the support base and the carousel base in two angular positions spaced one half of the way around the axis.

18. The wire uncoiler of claim 17 further comprising support gussets extending diagonally between each of the active and idle vertical supports and each of the active and idle mandrels, the active and idle restraining arms being pivotably mounted to the support gussets at pivot points, further comprising lever arms affixed to the active and idle restraining arms and projecting substantially perpendicular from each of the active and idle restraining arms at the pivot points, stop arms engaging the active and idle vertical supports limiting downward pivoting movement of the active and idle restraining arms.

19. The wire uncoiler of claim 18 further comprising latching means on each of the active and idle mandrels for removably latching each of the active and idle restraining arms in substantially horizontal position to facilitate loading of wire coils onto the active and idle mandrels.

20. The wire uncoiler of claim 17 further comprising a plurality of manual controls, one manual control for each spring mechanism, the manual controls adjusting the biasing force exerted by the spring mechanisms, the manual controls adapted to be manually actuated to adjust the biasing force of each spring mechanism.

21. The wire uncoiler of claim 20 wherein the spring mechanisms and the manual controls are mounted to the vertical supports wherein adjustment of the spring mechanism can be made when wire is being uncoiled off of the mandrel.

22. The wire uncoiler of claim 21 wherein each of the manual controls includes an extendible and retractable screw mechanism including a threaded shaft and a body having a threaded bore, the screw mechanism having a first end attached to one of the spring mechanisms and a second end adapted to be rotated to control the biasing force applied by the spring mechanism.

23. The wire uncoiler of claim 22 wherein each of the spring mechanisms comprise a coil spring in tension to create the biasing force.

24. The wire uncoiler of claim 23 wherein each of the restraining arms are pivotable about a pivot, each pivot being supported by one of the vertical supports, further comprising a plurality of lever arms, one lever arm for each restraining arm, each lever arm affixed to one of the restraining arms and projecting substantially perpendicular therefrom, the coil spring of each spring mechanism connecting the screw mechanism with the lever arm.

25. The wire uncoiler of claim 24 wherein the lever arms engage the vertical supports when the first end of the respective mandrel and the second end of the respective restraining arm are a predetermined distance apart setting a predetermined maximum distance between the first end of the respective mandrel and the second of the respective restraining arm.

26. The wire uncoiler of claim 22 further comprising a manual crank attached to the second end of the screw mechanism.

* * * * *